United States Patent [19]

Applegate et al.

[11] Patent Number: 4,620,891

[45] Date of Patent: Nov. 4, 1986

[54] APPLYING LABELS TO PACKETS

[75] Inventors: Barry G. Applegate; William C. London, both of London, England

[73] Assignee: Molins PLC, London, England

[21] Appl. No.: 769,636

[22] Filed: Aug. 26, 1985

Related U.S. Application Data

[63] Continuation of Ser. No. 472,367, Mar. 4, 1983, abandoned.

[30] Foreign Application Priority Data

Mar. 13, 1982 [GB] United Kingdom ..... 8207378

[51] Int. Cl.[4] ..... B65C 1/06; B65C 9/14

[52] U.S. Cl. ..... 156/212; 53/137; 53/415; 156/484; 156/568; 156/571; 156/DIG. 4; 156/DIG. 29; 156/DIG. 31; 221/211

[58] Field of Search ..... 156/212, 215, 475, 484, 156/566, 567, 568, 571, 572, DIG. 4, DIG. 29, DIG. 31; 53/137, 415; 221/211, 278

[56] References Cited

U.S. PATENT DOCUMENTS

| | | | |
|---|---|---|---|
| 1,543,822 | 6/1925 | Bronander | 156/485 |
| 1,652,040 | 12/1927 | Molins | 156/571 X |
| 2,703,660 | 3/1955 | Von Hofe et al. | 156/571 X |
| 3,379,601 | 4/1968 | Pagay | 156/568 |
| 4,198,258 | 4/1980 | Glösmann | 156/568 |
| 4,564,412 | 1/1986 | Oberdorf | 156/568 |

FOREIGN PATENT DOCUMENTS

| | | | |
|---|---|---|---|
| 0006505 | 6/1979 | European Pat. Off. . | |
| 357898 | 10/1931 | United Kingdom | 221/211 |
| 759741 | 10/1956 | United Kingdom | 156/484 |
| 765269 | 1/1957 | United Kingdom | 156/484 |
| 1171762 | 11/1969 | United Kingdom . | |
| 1415051 | 11/1975 | United Kingdom . | |
| 1437463 | 5/1976 | United Kingdom . | |
| 2031839 | 4/1980 | United Kingdom . | |
| 1575050 | 9/1980 | United Kingdom . | |
| 2079242 | 1/1982 | United Kingdom . | |

*Primary Examiner*—Michael Wityshyn

*Attorney, Agent, or Firm*—John C. Smith, Jr.

[57] ABSTRACT

Apparatus for applying revenue stamps to cigarette packets known as soft packs, includes an oscillating transfer arm 12 and a continuously driven suction drum 6 formed with projections, e.g. pairs of pins 10. The projections engage the rear edges of successive stamps transferred from a stack 2 by the arm, and thereby accurately align the stamps on the drum. The two modified arrangements shown in FIGS. 3 and 4 are particularly adapted for applying banderoles to hinged lid cigarette packets.

17 Claims, 4 Drawing Figures

APPLYING LABELS TO PACKETS

This is a continuation of application Ser. No. 472,367 filed Mar. 4, 1983, now abondoned.

This invention relates to apparatus for feeding and applying labels or the like to packets, in particular stamps or banderoles to cigarette packets.

In the cigarette packaging industry the machines for applying labels to packets usually each include a vertical stack or hopper containing a pile of labels. The bottom of the stack may then be oscillated and each successive lowermost label withdrawn from the stack by means of a feed rotor which applies suction to the label and peels it off at the moment when the stack and the rotor are rolling in contact with one another. Alternatively it has been proposed to have a fixed stack and to withdraw each successive label perpendicularly from the bottom of the stack by means of a reciprocating transfer arm to which suction is applied. However, the further transfer of the label onto a feed conveyor may result in a misalignment of the label, especially at high speed.

According to one aspect of the present invention there is provided apparatus for transferring a succession of labels or similar sheet like material from a supply member to a receiving member, one of the members being movable substantially in the lane of a label while the other member is stationary during the transfer, wherein the receiving member is formed with a suction surface and with a projection associated therewith, such that during movement of said one member the suction surface and the projection cooperate to engage and locate a label against the projection.

The receiving member may comprise a continuously movable rotor with a plurality of equi-spaced suction surfaces and associated projections formed thereon.

Such apparatus finds particular use in applying labels such as revenue stamps to the top ends of soft packs in order to hold the loose folded flaps (usually made of aluminium foil) securely down against the packets.

According to a second aspect of this invention apparatus for applying labels around the flaps at the top ends of packets comprising feed means for feeding packets laterally towards a label applying station, means for plunging each successive packet with said top end leading into a label, and a heater plate adjacent the feed means for engaging and flattening said flaps of the packet prior to the label being applied to the packet.

Figure 1:
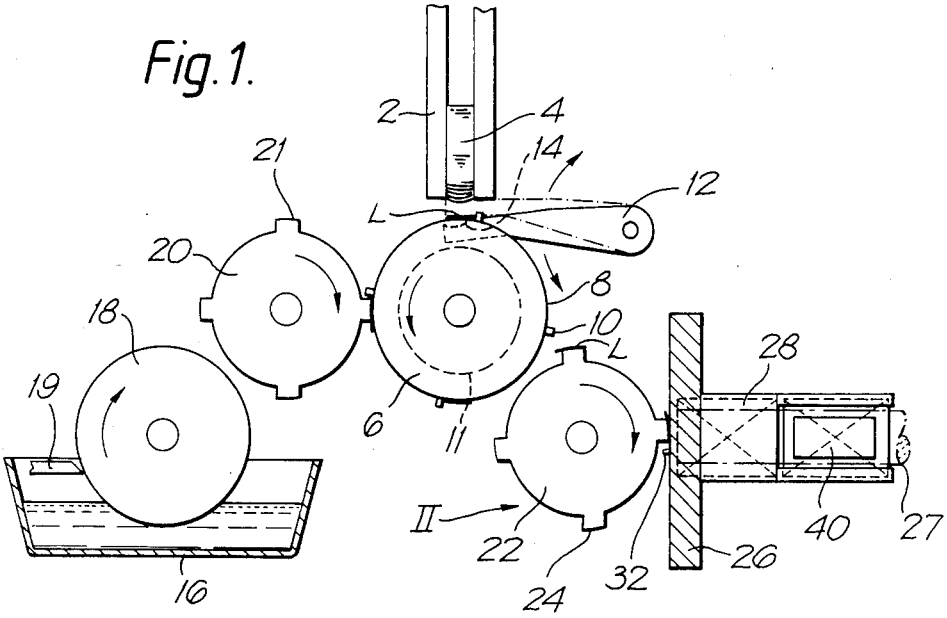
Figure 2:
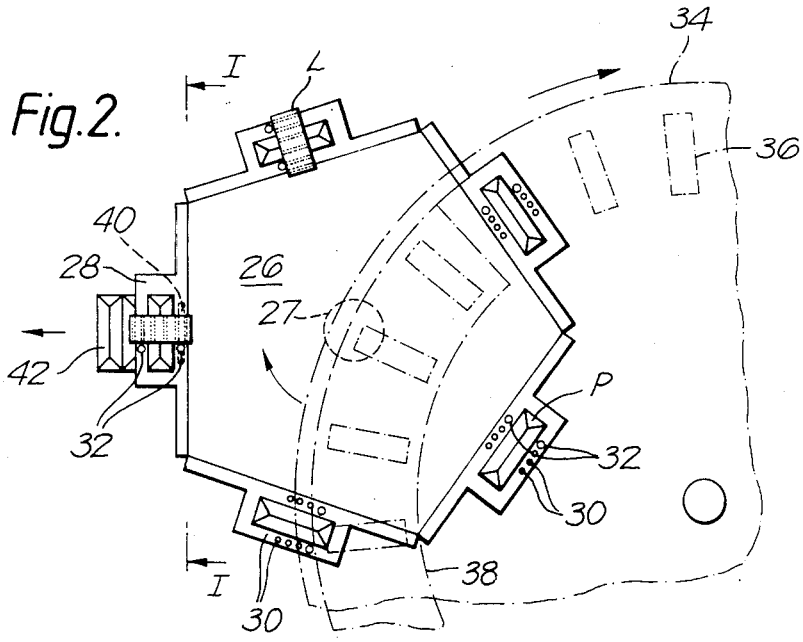
Figure 3:
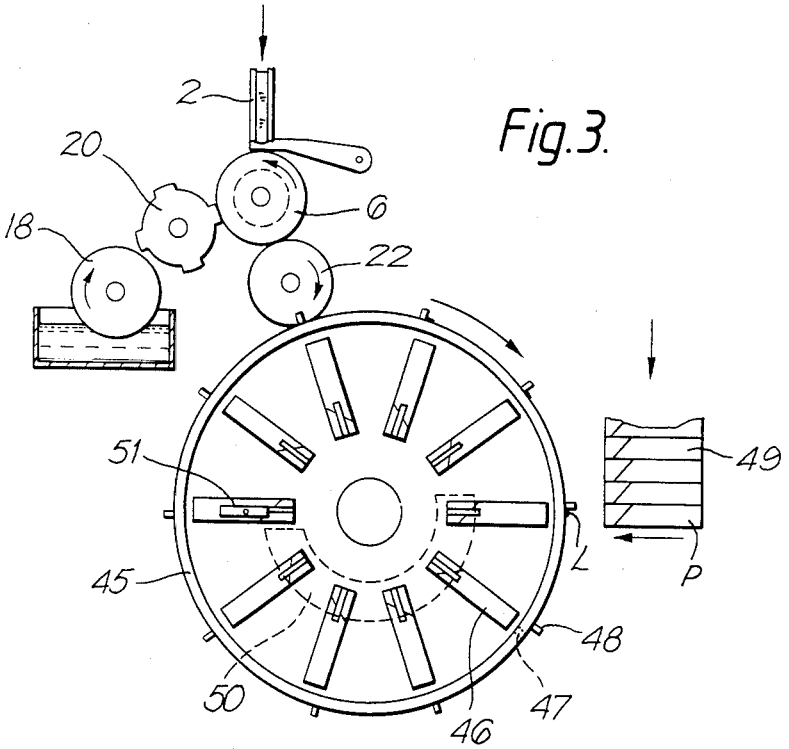
Figure 4:
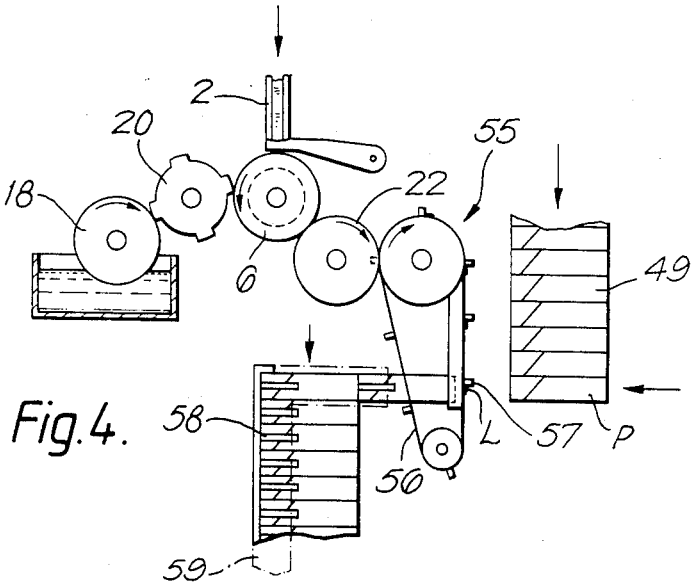

Two main embodiments of the invention will now be described, by way of example only, with reference to the accompanying drawings in which:

FIG. 1 is a side view of a machine for applying stamps to soft cigarette packets, being partly taken in section on the line I—I of FIG. 2, FIG. 2 is a front view of part of the apparatus as seen in the direction of arrow II of FIG. 1, FIG. 3 is a view similar to FIG. 1 but showing a machine for applying banderoles to hinged lid cigarette packets, and FIG. 4 is a modification of the embodiment of FIG. 3.

Referring first to FIGS. 1 and 2 there is shown a hopper or stack 2 containing a pile 4 of labels or stamps to be applied to cigarette packets. At the bottom of the hopper are small ledges (not shown) which support the edges of the pile of stamps. Spaced slightly from the bottom of the hopper is a rotor 6 mounted on shaft 6' having four sets of suction ports 8 equally distributed about its periphery. The rotor 6 is driven continuously anti-clockwise as shown by the arrow, and at a predetermined position behind each set of suction ports 8, as viewed in the direction of rotation of the rotor, are projections such as a pair of axially aligned pins 10 projecting radially outwards a short distance of about 2 mm from the periphery of the rotor.

Operating in the space between the bottom of the hopper 2 and an annular groove 11 in the rotor 4 is a horizontally disposed transfer arm 12 mounted at one end on shaft 12' and having at its free end an upwardly directed concave suction surface 14. The free end of the arm is oscillated through shaft 12' by a cam (not shown) between a position, shown chain dotted, in which the concave surface 14 engages a stamp L at the bottom of the stack and a lower position, shown in full lines, where it deposits the stamp onto one of the sets of suction ports 8 on the rotor 6. Drive means 15 connected to the shaft 6' rotates the rotor 6 in timed relationship with oscillation of the transfer arm 12 to bring successive sets of suction ports 8 on the rotor 6 into alignment with the concave surface 14 of the transfer arm 12 while in its lower position to receive successive stamps L therefrom.

To the left of the rotor 6 is a partially enclosed adhesive container 16, containing an adhesive such as PVA, into which dips a disc 18 whose periphery is doctored by a scraper 19 and which is continuously rotatable in a clockwise direction. A gum wheel 20, formed on its periphery with four shaped projections 21 and also continuously rotatable in a clockwise direction, is disposed between the disc 18 and the rotor 6 for the projections 21 successively to contact their peripheries, so as to transfer a shape or pattern of adhesive to a stamp L held at a suction port 8 on the rotor 6.

Slightly below and to the right of the rotor 6, as seen in FIG. 1, is a transfer wheel 22 having four suction pads 24 each having a shape to engage areas of a stamp L between the adhesive pattern. The transfer wheel 22 is also continuously rotatable by drive means 22' in a clockwise direction.

Immediately to the right of the wheel 22, as seen in FIG. 1, is a receiving member in the form of a stamp turret 26 indexable about a shaft 27, as is best seen in the front view of FIG. 2. The stamp turret has five equi-spaced stations each including a rectangular passage 28 of a suitable cross-section to receive a cigarette packet P in an endwise direction, and to accommodate two such packets in end to end contact.

The turret 26 is rotatable clockwise in steps of 72° corresponding to the spacing between its stations, so as to bring each successive passage 28 (when at the 9 o'clock position) into alignment with the transfer wheel 22. Formed in the front face at the entry to each passage 28 are two oppositely disposed rows of suction apertures 30 adapted to hold a stamp against the front face; and below each pair of rows of apertures (i.e. upstream thereof, as considered in the direction of the indexing of the turret 26) are projections such as a pair of pins 32 similar to the pins 10 on the suction rotor 6.

When a station of the turret 26 has been rotated to the 2 o'clock position, its passage 28 is aligned with a pocket 36 of a drying drum 34, shown in FIG. 2 chain-dotted at a position in front of the turret 26. The drying drum 34 is indexable in steps corresponding to the spacing between the pockets 36 in a clockwise direction, as shown by the arrow, and during such indexing the foil flaps at the top end of each successive cigarette packet P in a pocket 36 (i.e. the end which in FIG. 2 is facing into the plane of the drawing) are closed against the packet by folding tools (not shown). The closed foil flaps then come into contact with an arcuate fixed heating plate 38 which serves to fold flat and iron down these top folds of the packet, before the packet arrives at the two o'clock position of the turret 26 where it is to be plunged into a stamp.

Referring again to FIG. 1, the wider side walls at the back end of each passage 28 are cut away to allow a pusher 40 to extract a packet P sideways out of the passage, to form a row 42 of side-by-side packets.

The operation of the apparatus is as follows:

Referring to FIG. 1, the concave suction surface 14 of the arm 12 has withdrawn the lowermost stamp L from the pile 4 and is still holding it with a slight residual suction as a set of suction ports 8 in the rotor 6 are approaching under the stamp. Suction is now applied to these suction ports 8, and as suction starts to slip away the stamp L from the end of the arm 12, the pair of pins 10 engage the rear end of the stamp to complete the transfer. The pins 10 thus serve to locate and align the stamp L accurately relative to the rotor 6. The pattern of adhesive is next applied to the stamp by one of the projections 21 on the gum wheel 20, and the stamp transferred to the next approaching pad 24 on the drum 22.

The turret 26 is stationary as the stamp L is carried by the pad 24 to the front face of a respective passage 28. Suction at the pad is now removed, while suction applied at the apertures 30 slows down the stamp as it is brought to rest against the pins 32. Thus, similar to the function to the pins 10, the pins 32 serve to locate and align the stamp, if it has become slightly misaligned during transfer from the rotor 6.

After two indexing steps of the turret, the stamp L is brought in front of a packet P in a pocket 36 of the drying drum 34. At this position the top end of the packet has just left the heated plate 38 so that its foil flaps remain ironed and flat. The packet is then pushed out of the pocket 36 and plunged into the stamp, which is thus folded around the foil flaps of the packet by the side walls of the passage 28. At the same time the previous packet already in the passage, is pushed to the back end of the passage. After three further indexing movements of the turret 26 the previous packet, now at the back end of the passage 28, is extracted sideways by the pusher 40 to join the row 42 of packets.

It will be apparent that there has to be a gap between the top end of each packet in the drying drum 34 and the respective stamp on the turret, so that without the heater 38 one or both of the foil flaps at the top end of each packet would tend to spring open and possibly be crushed in being plunged into the stamp.

Turning now to the second embodiment shown in FIG. 3, which relates to a machine for applying banderoles to hinged lid cigarette packets, the rotor 6, the disc 18 and the gum wheel 20 are as described above, but the transfer wheel 22 is positioned lower than in FIG. 1. Below and slightly to the right of the drum 22 is a large packet drum 45 formed with ten equi-spaced radial pockets 46. At each side of the entry face to a pocket 46 are suction apertures 47 adapted to hold a banderole L. The drum 45 is indexable clockwise in steps corresponding to the spacing between the pockets. At the position behind the suction apertures 47, as viewed in the direction of indexing of the rotor 45, are pairs of axially aligned pins 48 similar to the pins 32 on the turret 26 described above.

To the right of the drum 45 is a vertical stack 49 of packets P at the bottom of which is a pusher (not shown) for pushing the lowermost packet P into a pocket 46 of the drum 45 as it comes to rest in line with the pusher.

Each successive banderole L (which is longer but narrower than a stamp) is picked up by the drum 6 from the hopper 2 as previously described, and is then transferred by the wheel 22 to the drum 45 so that it is aligned against the respective pair of pins 48, adhesive having meantime been applied to selected areas of the banderole.

As a packet P is plunged into a pocket in the drum 45, it picks up a banderole L, which is thus applied around the leading end and sides of the packet to secure the lid against the body of the packet. Held fixed against the front and rear sides of the drum 45 are heater plates 50 (only the rear one being shown) which serve to dry the adhesive at the ends of the banderoles against the sides of the packets. After five indexing movements each packet P is pushed by a pusher 55 axially sideways (i.e. perpendicular into the plane of FIG. 3) to a position next to the pocket 46, where it continues to rotate with the indexing drum 45 for one further revolution. After one further revolution the next packet in the adjacent pocket 46, on being pushed sideways by the plunger 51, in turn pushes the first packet axially out of the drum 45 from where it is conveyed (by means not shown).

A modification of the apparatus of FIG. 3 is illustrated in FIG. 4. Here the packet drum 45 is replaced by a conveyor 55 which consists of two parallel porous bands 56 provided with eight pairs of equi-spaced and aligned pins 57, similar to the pins 48 on the drum 45.

As with the apparatus of FIG. 3, there is a stack 49 of packets P to the right of the conveyor 55, and the pusher (not shown) slides each successive bottom-most packet horizontally through the gap between the bands 56, on which a banderole L is held by suction and located by means of the pins 57. The packet P is then pushed further into another vertical stack 58, which is provided with a heater 59 similar to the heater 50 of FIG. 3, in order to dry the adhesive on the banderoles.

We claim:

1. A method of feeding individual labels from a stack of labels in aligned succession comprising:

(a) supporting said labels in a stack from one end of which labels are successively withdrawable;

(b) withdrawing each successive label from said one end of said stack;

(c) transferring each of said successive labels towards a surface of a conveyor continuously moving along a path and on which are formed a succession of spaced projection means and to which suction is applicable upstream, considering the direction of movement of said conveyor along said path, of each projection means to retain a label on said surface of said conveyor; and (d) depositing each of said successive labels onto said surface of said conveyor with the respective projection means abutting the trailing edge of said label to correctly align said label before it comes under the complete control of said suction of said conveyor.

2. The method as claimed in claim 1 in which each of said successive labels is withdrawn from said one end of said stack in a direction substantially perpendicular to the plane of said label.

3. A method as claimed in claim 1 further comprising the step of applying adhesive to each of said successive labels while on said surface of said conveyor.

4. The method as claimed in claim 3 further comprising transferring each of said successive labels with said adhesive from said surface of said conveyor to a transfer conveyor, transporting each of said successive labels along a further path on said transfer conveyor toward a receiving member having at least one further projection means and to which suction is applicable upstream, considering the direction of movement of said transfer conveyor along said further path, and depositing each of said successive labels onto said receiving member with the respective further projection means abutting the leading edge of said label to correctly align said label before it comes under the complete control of said suction of said receiving member.

5. The method as claimed in claim 4 further comprising feeding a succession of articles into contact with said adhesive on said succession of labels while retained on said receiving member by said further suction to secure each successive label to each successive article.

6. A method as claimed in claim 1 further comprising the step of reactivating adhesive on each of said successive labels while on said surface of said conveyor.

7. The method as claimed in claim 6 further comprising transferring each of said successive labels with said adhesive from said surface of said conveyor to a transfer conveyor, transporting each of said successive labels along a further path on said transfer conveyor toward a receiving member having at least one further projection means and to which suction is applicable upstream, considering the direction of movement of said transfer conveyor along said further path, and depositing each of said successive labels onto said receiving member with the respective further projection means abutting the leading edge of said label to correctly align said label before it comes under the complete control of said suction of said receiving member.

8. The method as claimed in claim 7 further comprising feeding a succession of articles into contact with said adhesive on said succession of labels while retained on said receiving member by said further suction to secure each successive label to each successive article.

9. The method of claim 1 wherein each successive label is withdrawn from said one end of said stack and transferred toward said surface of said conveyor by a transfer device to which suction is applied during transfer to retain said label on said transfer device and said suction is not fully terminated before said respective projection means abuts the trailing edge of said label to retain at least partial control of said label and correctly align said label on said surface of said conveyor.

10. A method of successively feeding individual labels from a stack of labels comprising:

(a) supporting said labels in a stack from one end of which labels are successively withdrawable;

(b) withdrawing each successive label from said one end of said stack;

(c) transferring each of said successive labels towards a surface of a conveyor continuously moving along a path and on which is formed at least one projection means and to which suction is applicable upstream, considering the direction of movement of said conveyor along said path, of said projection means to retain a label on said surface of said conveyor; and (d) depositing each of said successive labels onto said surface of said conveyor with said at least one projection means abutting the trailing edge of said label to correctly align said label before it comes under the complete control of said suction of said conveyor.

11. Apparatus for feeding labels successively comprising:

(a) stack means for supporting a fixed upright stack of labels, said stack means having a bottom from which successive labels are withdrawable;

(b) rotor means spaced from said bottom of said stack means and arranged for rotation in a predetermined direction;

(c) at least one suction means provided on said rotor means for receiving a label;

(d) transfer means arranged for movement along a path between said bottom of said fixed stack and said rotor means for fully withdrawing each successive lowermost label entirely from said bottom of said stack means and transferring said label directly to said at least one suction means on said rotor means;

(e) projection means formed on said rotor means downstream of each of said at least one suction means as considered in the direction of rotation of said rotor means; and (f) drive means for driving said rotor means continuously in timed relationship with the movement of said transfer means along said path to bring said at least one suction means adjacent to said bottom of said stack means, such that while said transfer means still retains at least partial control of said label and before said label comes under the complete control of said at least one suction means said projection means abuts the trailing end of the label to correctly align the label with said rotor means.

12. Apparatus according to claim 11 in which said transfer means comprises a transfer arm having suction means for retaining successive labels thereon, said transfer arm being pivotable along said path between said bottom of said stack and said rotor means.

13. Apparatus according to claim 11 further comprising a receiving member spaced from said rotor means, said receiving member having at least one suction means; a transfer drum rotatably positioned between said rotor means and said receiving member to transfer each successive label from said rotor means directly to said at least one suction means of said receiving member; further projection means mounted on said receiving member adjacent each of said at least one suction means and adapted to engage the leading edge of a label on being transferred to said receiving member by said transfer drum; and drive means for driving said transfer drum continuously to bring each successive label on said transfer drum adjacent said at least one suction means of said receiving member, such that while said transfer drum still retains at least partial control of said label and before said label comes under the complete control of said at least one suction means of said receiving member said further projection means abuts the leading edge of the label to correctly align the label with said receiving member.

14. Apparatus according to claim 13 in which said receiving member is an indexable turret having a plurality of suction means thereon and in which an aperture is provided adjacent each of said suction means through which an article to which a label is to be applied is movable, said transfer drum and each of said suction means and further projection means of said turret being arranged to position a label over one of said apertures in said turret, whereby with the label held across said aperture by one of said suction means of said turret the article may be plunged into the label for application thereto.

15. Apparatus according to claim 11, in which said projection means comprises at least two pins extending from said rotor means adjacent said suction means to locate a label in alignment with said at least two pins.

16. Apparatus according to claim 11, further comprising adhesive means associated with said rotor means for applying adhesive to each label on said rotor means.

17. Apparatus according to claim 11 wherein said transfer means is adapted to fully withdraw each successive lowermost label entirely from said bottom of said stack means in a direction substantially perpendicular to the plane of said label.

* * * * *